US006119426A

United States Patent [19]

Escudero

[11] Patent Number: 6,119,426

[45] Date of Patent: Sep. 19, 2000

[54] HEATHER BLOCKS

[76] Inventor: Gary A. Escudero, 1006 Susan Ave., Gallup, N. Mex. 87301

[21] Appl. No.: 09/182,001

[22] Filed: Oct. 29, 1998

[51] Int. Cl.[7] ..... E04C 1/39

[52] U.S. Cl. ..... 52/503; 52/220.1; 52/300; 52/DIG. 9; 446/111; 446/124

[58] Field of Search ..... 52/220.1, 300, 52/503, 606, 607, 582.1, DIG. 9; 446/120, 122, 111, 117, 118, 124

[56] References Cited

U.S. PATENT DOCUMENTS

| | | | |
|---|---|---|---|
| 599,864 | 3/1898 | Rapp | 52/606 X |
| 888,399 | 5/1908 | Hengerer | 52/606 |
| 1,319,113 | 10/1919 | Reagan | 52/503 |
| 1,753,776 | 4/1930 | De Vilbiss | 52/DIG. 9 |
| 3,222,840 | 12/1965 | Rosenfeld . | |
| 3,721,059 | 3/1973 | Reynolds | 52/DIG. 9 X |
| 3,766,667 | 10/1973 | Glassman | 446/122 X |
| 3,834,100 | 9/1974 | Healey | 52/607 X |
| 3,902,270 | 9/1975 | Molenaar | 446/122 |
| 4,040,630 | 8/1977 | Brattain | 446/118 X |
| 4,577,447 | 3/1986 | Doran . | |
| 4,741,140 | 5/1988 | Nakamura . | |
| 4,947,610 | 8/1990 | Koerner | 52/606 X |
| 5,087,150 | 2/1992 | McCreary | 52/606 X |
| 5,199,919 | 4/1993 | Glickman | 446/124 X |
| 5,411,782 | 5/1995 | Jarvis et al. | 52/503 X |
| 5,575,128 | 11/1996 | Haener . | |

*Primary Examiner*—Beth A. Stephan
*Assistant Examiner*—Brian E. Glessner

[57] ABSTRACT

Building block systems that can utilize either commonly available containers locked and spaced together by locking members or a pre-molded one piece container and locking member system. Either system can utilize two or four spaced containers in the locking member. Also, both systems may use commonly available material, such as sand or dirt, to fill the top opened containers to provide insulation and strength to the vertically formed structure. Interior and exterior facing materials, such as sheet rock, lattice for applied stucco, precast rock or brick may be attached to the joined containers. Locking members may have internal parallel raceway holes in which backing strips may be inserted to permit the attachment of the the exterior and interior panels to the blocks. Either vertical or horizontal cut out portions may extends along the interior side of the locking members to permit utility conduits (pipes, wires, etc.) to be inserted before the interior panel is fastened.

2 Claims, 3 Drawing Sheets

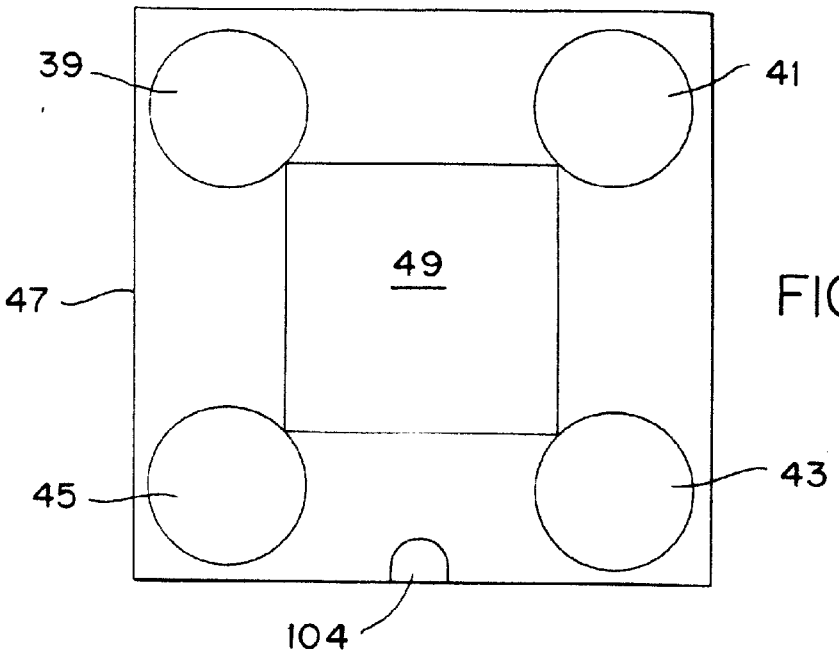
FIG. 4
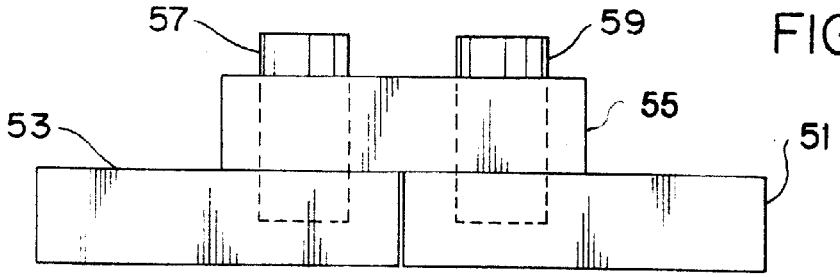
FIG. 5
FIG. 6
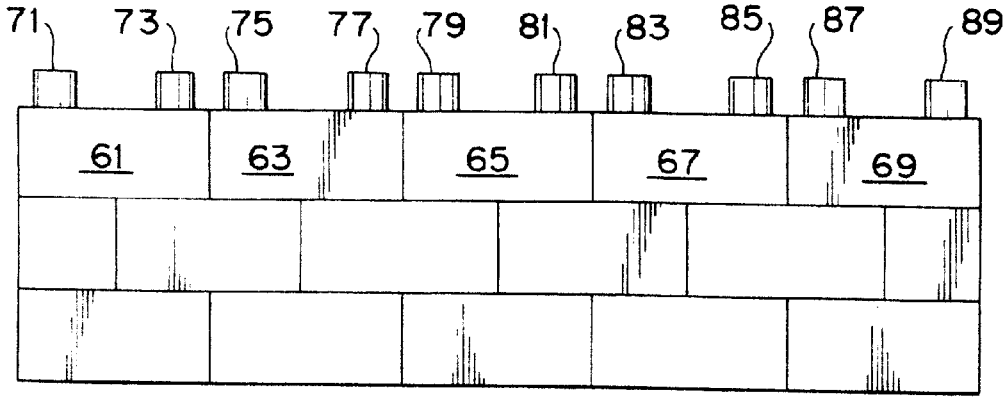

HEATHER BLOCKS

BACKGROUND OF THE INVENTION

A very great variety of different block type materials have been used by persons to provide building materials for houses, walls and other man built structures. In some cases the normally rectangular building blocks are modified such that they are double thickness and are structurally interrelated to provide a superimposed overlapping block structure. Other building blocks have used expanded polystyrene beads arranged in a vertically oriented, horizontally staggered relationship. Still other building blocks have used hollow concrete block units laid in courses with front and rear panel members and side panel assemblies which form a gap between two adjacent block units. Reinforcing bars assist in holding the panel assemblies and a body of cement material can be used to fill any gaps. One further building block system has used interlocking mortar less blocks wherein the blocks are laid up in courses in a staggered relationship.

The present invention envisions two similar building block systems the first of which consist of recycled common containers filled with available material and locked together in courses by locking members while the second system consists of a similar system with a pre-molded one piece system having a container and a locking members all as will be described hereafter.

DESCRIPTION OF THE PRIOR ART

Building block systems are known. For example, in the Rosenfeld invention (U.S. Pat. No. 3,222,840) the superimposed courses of blocks have a layer of mortar there between with each block having a notched end.

The Doran patent (U.S. Pat. No. 4,577,447) discloses an interlocking construction block made of expanded polystyrene beads having a pair of vertically aligned openings. When assembled, rigid reinforcing rods are placed between the blocks.

In the Nakamura reference (U.S. Pat. No. 4,741,140) the disclosed masonry wall structure uses hollow concrete block units with front and rear panel members and a pair of side panel assemblies which form a gap between adjacent two block units. Reinforcing bars project rearwardly and forwardly from the front and rear panel members into the gaps. A cement material is used to fill the gaps.

In the Haener reference (U.S. Pat. No. 5,575,128) an interlocking mortar less building block system is disclosed having an interlocking system with each of the blocks has a pair of upright sidewalls with flat top and bottom surfaces. Protrusions on the inner surfaces of the sidewalls extend from a base generally coplanar with the bottom surface to a tip extending above the top surface and configured so that the tips and bases interlock when the blocks are laid up in staggered courses.

The present invention relates to a rammed earth block building system which may utilize either of two similar systems. In the first system recycled common containers are locked together with locking members in both a horizontal and vertical direction and filled with commonly available fill material. In the second system, a variation of the first system, pre-molded one piece containers having their own locking members also use commonly available fill material. The details of these two systems and additional associated components used with them are all more fully set forth in this specification.

SUMMARY OF THE INVENTION

This invention relates to building block systems that can utilize either commonly available containers locked together or pre-molded one piece container systems having locking members. With either system commonly available material are used to fill the containers. Interior and exterior facing materials, such as sheet rock or lattice for applied stucco, may be attached to the joined horizontal and vertical containers.

It is the primary object of the present invention to provide for an improved building block system that utilizes commonly found fill materials as filler material.

Another object is to provide for such a system wherein interior and exterior panel surfaces may be attached or applied over the blocks to mimic conventional exposed surfaces.

These and other objects and advantages of the present invention will become apparent to readers from a consideration of the ensuing description and the accompanying drawings.

BRIEF DESCRIPTION OF THE DRAWINGS

FIG. 4 is a top view of the containers and locking members as used in a second system preferred embodiment.

FIG. 5 is a front view of the second system containers and locking members interlocked together.

FIG. 6 is a front view of a wall formed by the second system containers and locking members when interlocked together.

DESCRIPTION OF THE PREFERRED EMBODIMENT

Figure 1:
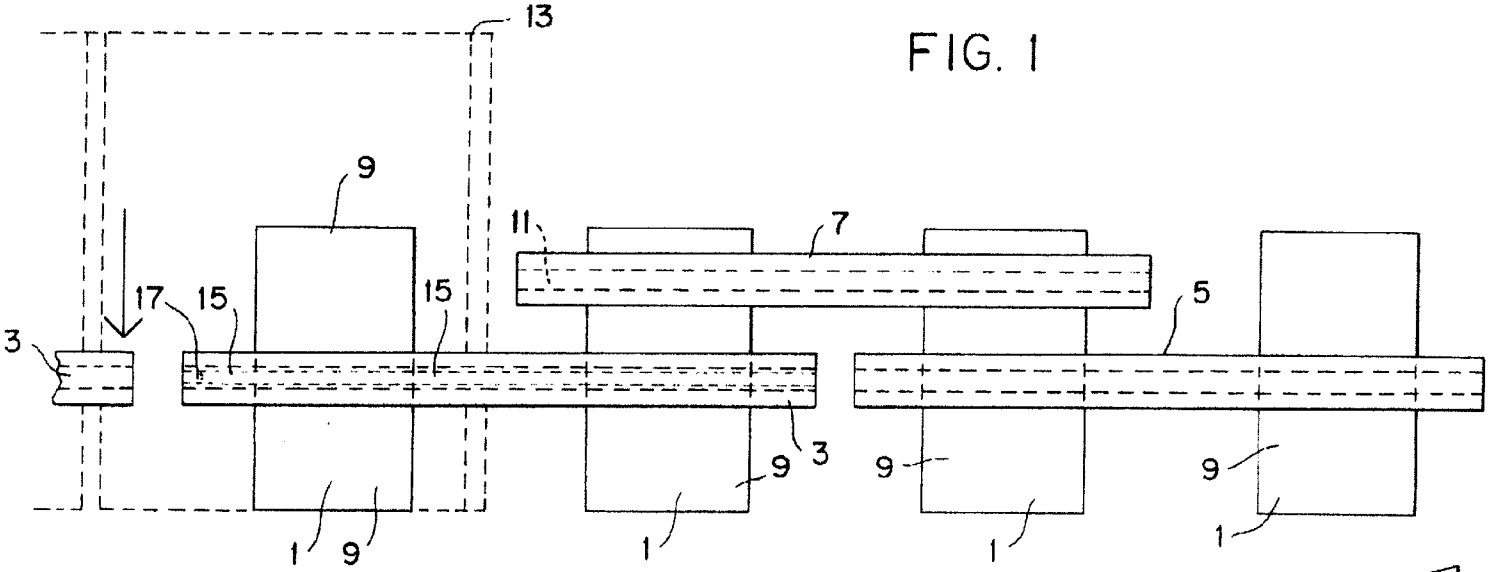
FIG. 1 is a front view of the first system of the invention's preferred embodiment showing several containers held together in pairs by separate locking members.

FIG. 1 is a front view of the first system of the invention's preferred embodiment showing several identical top opened containers 1 held together in spaced pairs by separate locking members. In this view two horizontally disposed locking members 3 and 5 each lock and space two containers. Above these two horizontally aligned locking members and their four containers is a third locking member 7 which joins together and spaces two adjacent containers one of which is held by each of the other two locking members 3 and 5. Each container 1 is partially filled with any commonly available fill material 9 such as sand, dirt, rubble, that is inert and can provide some thermal insulation.

The identical containers I may be any containers that are closed on their bottoms and sides with opened tops such as recycled containers or buckets. Examples, of containers that could be used include five gallon paint cans, stucco containers or dry wall paste materials containers. Main vertically disposed spaced holes within each locking member 3,5 and 7 permit the two engaged containers to be both spaced and firmly held by the locking members. Flanges on the sides of these main holes prevent the inserted containers from falling through the holes. A second pair of spaced horizontally disposed parallel holes 11 extends the total horizontal distance or total length of each locking member. These second pair of holes extend along both sides of the main vertical holes into which the containers fit. As will explained in more detail with respect to FIG. 7, these horizontally disposed holes 11 form two spaced raceways that permit parallel wooden strips to be inserted into the interior and exterior sides of the locking members to act as backings for panel surfaces. These panels can then be nailed, screws or otherwise affixed to the inserted strips. As shown in dotted line format a panel, here an interior flat sheet of conventional dry wall material 13, like a 4 by 8 foot sheet, is attached at its lower portion by screws 15 extending into a wooden strip 17 (also shown in dotted line format) running the total length of the locking member 3 that had previously been inserted into the interior side or the inner raceway of the hole member 11. Similarly, the other locking member 5 and 7 have similar main vertical holes for the containers and two horizontally disposed parallel smaller raceway holes for inserting backing strips used to fasten either exterior panel siding or interior panel surfaces, or both, surface panels to the system.

Figure 2:
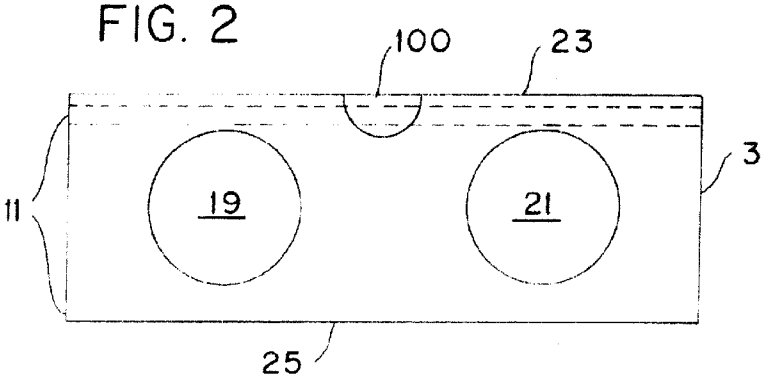
FIG. 2 is a top view of a straight locking member used in the FIG. 1 first system preferred embodiment.

FIG. 2 is a top view of the straight locking member 3 used in the FIG. 1 first system preferred embodiment. Locking members 5 and 7 each have an identical construction. Two main spaced parallel holes 19 and 21 extend through the height of the locking member 3. Extending along both sides of these main holes are the generally smaller two raceway holes 11. These parallel smaller raceway holes are located adjacent the interior side 23 and the exterior side 25 back and front surfaces of member 3 but do not intersect with the main holes nor do that penetrate the locking members opposite adjacent outer surfaces. With this construction planar panel surfaces may easily be fastened to the interior backing strips 17 (not shown in this figure) that have been inserted into the raceway holes and held thereto by nails, screws or any other members that can penetrate through the small amount of locking member material located between the raceway holes and the member's near surface side. The applied exterior vertically disposed panel surfaces may be fire retardant surface panels that mimic block, adobe, rock or any other commonly used exterior surface. The interior panel surfaces can also be any commonly used interior panel surfaces such as sheet rock, wooden or pressed fiberboard panels, etc. Also, depicted in this figure is a vertical cut out portion 100 used for a plumbing or electric conduit in the locking member 3.

Figure 3:
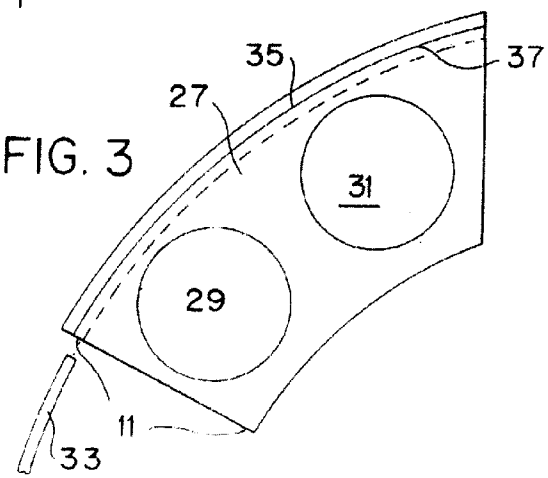
FIG. 3 is a top view of a curved locking member usable around corners with the FIG. 1 first system preferred embodiment.

FIG. 3 is a top view of a curved locking member 27 usable around corners used with the FIG. 1 first system preferred embodiment. Two main holes 29 and 31 are used to encircle inserted containers such as those shown in FIG. 1. Here again interior locking member raceway holes 11 extend along the total length of the curved locking member and along both sides of the main holes to act as receiving orifices for bendable backing strips 33 (one is partially shown) that can be inserted into each raceway hole. By pacing an exterior panel 35 flush with and along the outer surface edge 37 of the locking member 27 fasteners may be placed into each backing strip from outside the house or structure to hold the panel to the backing strip and locking member. Clearly, the angle of curvature for the locking member 27 can be varied to suit its particular use and desired result. Thus, right angled curved locking members or other curved locking members having different angular orientations are envisioned.

FIG. 4 is a top view of the containers and locking members as used in second system preferred embodiment. This second system is similar to the first system and has many of the same features. It may use a single precast component incorporating 2 containers exactly like those shown in the first embodiment or may used 4 precast component containers. In FIG. 4 the individual four main container holes have containers 39,41,43 and 45 inserted therein in the spacing member 47 and are pre-molded together as a single unit. Each container 39,41,43 and 45 is held to the member 47 and is opened on the top side and closed on all other sides. Since, the second embodiment is manufactured as a precast single component there is no need for side raceway holes with backing strips as the outer surfaces can be made of a fire retardant material that would mimic block, precast rock, brick, abode, or any other convenient exterior surface in appearance. However, a vertical or horizontal, or both cut out portion may be provided along the inner facing block surfaces of the locking members to allow conventional utility lines like electrical or plumbing conduits (wires, pipes, etc.) to be inserted such as the vertical cut out 104 shown. This is true whether two or four containers are manufactured as a precast single component. Similar manufactured interior surfaces may look like sheet rock faces or paneling surfaces. Of course, like the first embodiment raceway holes with backing strips could be used in the second system if desired. If such were done, exterior and interior facing panel surfaces would be applied over the pre-molded blocks as in the first system. Within the hollow enclosed interior cavity 49 an insulating core material may be added such as fiberglass, foam, etc.

FIG. 5 is a front view of the second system containers and locking members interlocked together. Each of the pre-molded blocks 51,53 and 55 are held together or interlocked by extending upper portions of the containers 57 and 59 used to mate with lower female orifices in the next higher set of interlocking blocks.

FIG. 6 is a front view of a wall formed by the second system containers and locking members when interlocked together. In this figure each block is like the FIG. 4 block with four extending upper portions with only the near two of which are shown. Thus, for the upper set of five blocks 61,63,65, 67 and 69 there would be a total of twenty upper opened container protrusion portions ten of which are shown as designed by the numbers 71,73,75,77,79,81,83,85,87 and 89.

Figure 7:
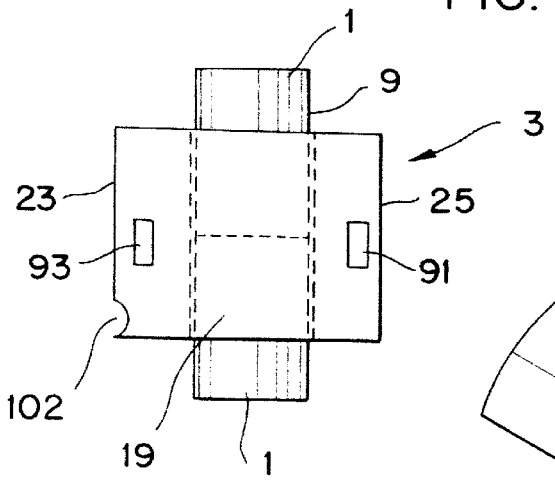
FIG. 7 is a side view of the blocking system illustrating a race way that can be used for inserting material used to support the block facing surfaces.

FIG. 7 is a side view of a locking member like member 3 illustrating a race way that can be used for inserting material used to support block facing panel surfaces. With slight modifications these same raceway holes could be used with either the first or second blocking systems. For illustrative locking member 3 from the first system was chosen looking in the direction of the arrow shown in FIG. 2. The two parallel interior locking member raceway holes 91 (exterior) and 93 (interior), collectively previously referred to as raceway holes 11, are located adjacent member interior surface 23 and exterior surface 25. A third interior cut out portion 102 extending lower and parallel to hole 93 used for plumbing and electrical conduits is also shown. The container 1 with the chosen fill material 9 is held in the lock members hole 19 while part of the locking member extends on both sides of the raceway holes and also separates them from the main hole 19. In this figure the raceway holes are straight to follow the length and particular configuration of the locking member. With curved outer and inner surfaces for the locking member the raceways holes would be modified to follow the same surface configurations.

Figure 8:
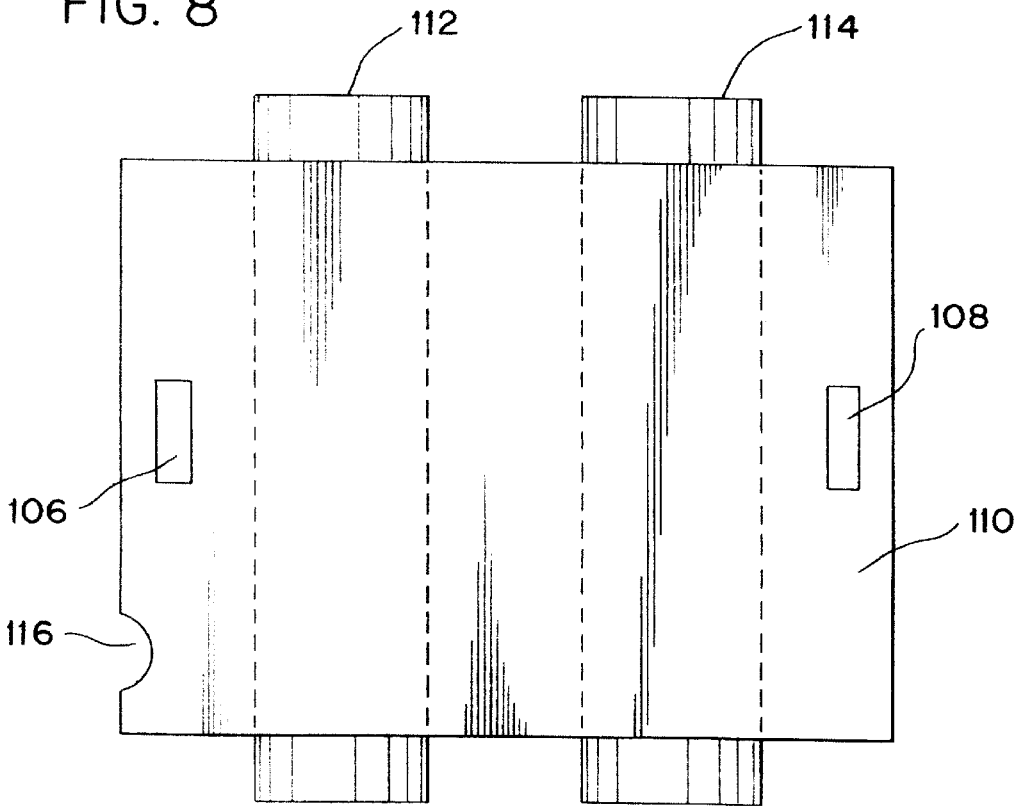
FIG. 8 is a side view of the blocking system illustrating a race way that can be used for inserting material used to support the block facing surfaces when four containers are held by a single locking member.

FIG. 8 is a side view of the four container blocking system illustrating a race way that can be used for inserting material used to support the block facing surfaces when held by a single locking member. This may be used with either the first embodiment or the second embodiment when side raceways are precast into the block. In this shown system the parallel two side raceways 106 (interior) extending along the sides of the locking member 110 that has two holes with the containers 112 and 114. Actually there are four containers, the other two being directly behind the shown containers in the same locking member 110. Along the interior side of the block is the horizontal conduit 116 which is extends parallel to the raceway 106 and is used to receive plumbing or electrical members normally inserted into the walls of structures, like pipes, wires, etc.

Figure 9:
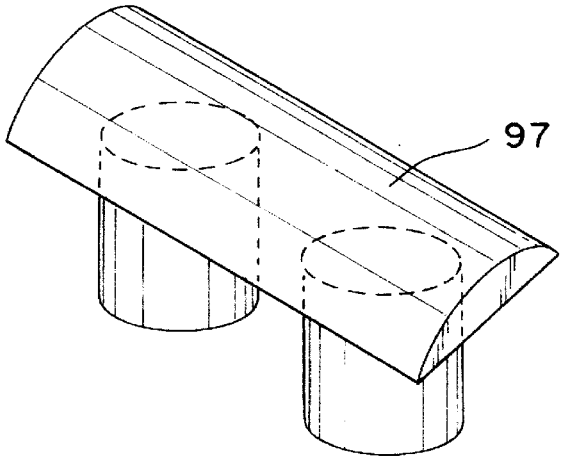
FIG. 9 is a top perspective view of a capping section used with either the first or second systems and illustrates their depending half containers used to interlock with lower containers.

FIG. 9 is a top perspective view of a capping section used with either the first or second systems with their depending lower half containers used to interlock with lower containers. A molded cap 97 used to cap the last and upper course of blocks on a structure's wall can be held to the last upper course. Anchor bolts or concrete can be used to attach a roof or other structure to this capping member if desired.

One of the main advantages of the systems described herein is that any person could embed the first layer of blocks in a traditional conventional foundation and then fill in the containers or bucket members with sand or rubble. Higher rows layered over this first row would be filled in with similar material as the container's protruding upper portions interlock with adjacent blocks. To add supporting strength to the vertically disposed blocks, re bars (re enforcing steel bar) could be inserted into the locking members both horizontally and vertically.

The vertical spacing between the aligned and interlocked blocks may act as space for plumbing conduits and for electrical raceways. For example, in FIG. 2 and FIG. 7 an additional cut out portion shown in the locking member 3 designated is shown on the interior side of the member can be either vertical 100 (FIG. 2) or horizontal 102 (FIG. 7) to receive the plumbing conduits and electrical raceways.

Although the preferred embodiment of the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A block building system comprising of;

a first set of at least two fill material receivable containers with each container having a closed bottom, closed sides, and a top to receive any inserted fill;

a first locking member for holding and spacing said first set of at least two containers with respect to each other, said locking member having at least two main holes spaced from each other with each hole being adapted to receive one of said at least two containers;

a second set of at least two fill material receivable containers with each container having a closed bottom, closed sides, and a top with an opening to receive any fill material;

a second locking member for holding and spacing said second set of two at least containers, said locking member having at least two main holes spaced from each other with each hole being adapted to receive one of said at least two containers;

a third locking member for holding and spacing one of the adjacent containers from the first set and the second set of containers;

each of said three locking members having raceway channels extending along their respective lengths for the purpose of receiving at least one of a backing strip, reinforcement, and utilities;

there are at least two raceway channels for each of said locking members, said raceway channels extending around the main container receiving holes for each locking member on both sides of the main holes;

said raceway channels intersect vertical cut outs to allow utilities to be routed; and upper capping members having at least two depending members each of which is adapted to engage the opening in the two containers from said first set of containers.

2. The block building system as claimed in claim 1, wherein each of said first set of containers and their first locking member and said second set of containers and their individual second locking members are each pre-molded as a single unitary separate structure; and the single unitary structure includes at least one of interior and exterior pre-molded surfaces and has panels adapted to attach to backing strips in the raceway channels.

* * * * *